United States Patent [19]

Lee

[11] 3,996,664

[45] Dec. 14, 1976

[54] NON-SCRATCHING KNIFE

[76] Inventor: Herbert P. Lee, Cannon Hill, R.D. 1, Brodbecks, Pa. 17308

[22] Filed: July 7, 1975

[21] Appl. No.: 593,691

Related U.S. Application Data

[63] Continuation-in-part of Ser. No. 521,056, Nov. 5, 1974, abandoned.

[52] U.S. Cl. ..... 30/286; 30/336

[51] Int. Cl.[2] ..... B26B 9/02; B26B 29/02

[58] Field of Search ..... 30/286, 346.58, 335, 30/329, 336

[56] References Cited

UNITED STATES PATENTS

| | | | |
|---|---|---|---|
| 527,175 | 10/1894 | Hurd | 30/286 |
| 933,626 | 9/1909 | Coomber | 30/286 |
| 1,846,622 | 2/1932 | Thompson | 30/346.58 |
| 2,316,985 | 4/1943 | Niedermayer | 30/335 |
| 3,842,501 | 10/1974 | Honma | 30/286 |
| 3,888,005 | 6/1975 | Bagwell | 30/286 |

*Primary Examiner*—Al Lawrence Smith
*Assistant Examiner*—J. C. Peters
*Attorney, Agent, or Firm*—Robert Ames Norton; Saul Leitner

[57] ABSTRACT

Knives including a cutting blade and one or more wider non-cutting runners projecting slightly beyond the cutting edge of the blade and preferably at both ends of the knife blade. The runners prevent scratching of a substrate on which the material, normally a comestible, is being cut. On each runner there is provided on either side a beveled ramp inclined toward the adjacent cutting surface which acts very much as a plowshare to push up the material being cut against the cutting blade. This prevents a thin strip of material which would otherwise not reach the cutting blade and is particularly important with comestibles such as meat, which are sufficiently tough to permit forming such a thin strip. Where knives are manufactured, the ramps or plowshares can be incorporated in the knife blade when it is manufactured. However, there is included the provision of attachable runners for knives which have already been made. These runners, which are of the same shape, are provided with a groove in which the cutting blade extends and are attached to the blade firmly, preferably by a strong, waterproof adhesive, such as an epoxy cement. Blades may be inserted in a handle designed to receive them where a number of blades are desired without the cost of separate knives.

5 Claims, 19 Drawing Figures

51
36
33
56

51
53
36
33
36
57
36
33
36
56
9
9

74
72
33
75

81
15
15
82
83

82
81

82
81

81
13
13
82
83
12
12

82
83

NON-SCRATCHING KNIFE

RELATED APPLICATION

This application is a continuation-in-part of my earlier application Ser. No. 521,056, Nov. 5, 1974, which application is now abandoned.

BACKGROUND OF THE INVENTION

Many materials, particularly comestibles, are cut or chopped on a substrate, such as a wooden block, counter surface, and the like. The sharp blade at at least one end can easily cut or scratch the substrate unless the knife is used with great care. Even with metallic surfaces, scratching is possible; and china, though not as vulnerable, can also be scratched with knives used at the table. This problem has been encountered for at least nearly a century and efforts have been made to prevent cutting or scratching of the substrate. This has been accomplished by having the knife blade, usually front and rear, widened and projecting slightly from the sharp cutting edge of the blade. The first, and still the best, form of runners are described for a cake knife in the old patent to Hurd, U.S. Pat. No. 527,175, of 1894. Recently a patent to Honma, U.S. Pat. No. 3,842,501, Oct. 1974, develops a plurality of sightly projecting, blunt surfaces all along the blade. Similar solutions to the safety razor blade have also been proposed but this is, of course, very remote and not strictly analogous to knives for cutting comestibles, to which the present invention is directed.

While the Hurd and Honma patents referred to do in fact prevent cutting or scratching of surfaces where comestibles are being cut or chopped, they have one very serious drawback. With very springy materials, such as cakes, for which the Hurd knife was developed, the knives are practically useful. However, for the cutting of other comestibles, such as meats, which are much tougher and can form thin strips where they do not encounter the recessed blade, satisfactory results are difficult to obtain. It is with an improved non-cutting and non-scratching knife which is useful for a much wider range of comestibles that the present invention deals.

SUMMARY OF THE INVENTION

The present invention eliminates any problem of a narrow strip of uncut comestible, which is particularly serious with materials such as meat, tough flexible cheeses, and the like. According to the present invention each of the wider portions of the knife which act as runners and prevent cutting or scratching by the slightly recessed sharp blade are provided with sloping ramps slanting up toward the adjacent portions of sharp cutting edge of the blade. These ramps are gently sloped and may be beveled so that when the knife is used for cutting or chopping any back or forward motion, which is always used, causes the material cut to move up the ramp and encounter the sharp blade. This prevents forming uncut narrow strips with materials such as meat and, while retaining all of the non-scratching properties of the Hurd and Honma patents, completely removes the problem of uncut strips. In other words, the present invention is not a compromise but possesses all of the good features of the prior art and in addition removes the disadvantages features. This is a fortunate and sometimes rare situation as many inventions involve some compromise. In the present invention there is no compromise.

The ramps raise the comestible only a very short distance to contact the sharp edge of the blade. The action of the ramp is quite similar to the raising action of a plowshare, and in the parent application above referred to this term is sometimes used. It means, of course, the same as the ramps, and in the present application this terminology will be used.

The present invention is not limited to antiscratching runners at two ends of a knife blade. There may be only runners at the front end for certain knives where the use would not result in scratches from the rear end of the knife blade and more than two can be used where this is considered desirable.

The present invention is not limited to the use of any particular material. When the knives are made originally with the runners and raising ramps or plowshares, usually the material will be the same as that of the knife itself. However, it may be different, and this is more likely to occur in the modification of the present invention where the runners are attachable to existing knives. In every case, of course, the material of the runners must be compatible with the use, including washing, of the knives.

The exact angle of the ramp is not what distinguishes from the prior art. The slope in every case should be sufficiently great so that materials being cut or chopped will readily move up the ramp. Normally the angle of the ramp should be acute but its exact value is not the essence of the present invention so long as the angle is sufficiently gradual that comestibles cut will readily move up the very small vertical rise of the ramp and be forced into contact with the recessed sharp edge of the knife. It is sometimes desirable where a number of knives are needed to purchase blades only with a single handle, the blades and handle being designed for firm attachment to each other by permitting ready change. A typical fastening will be described in a section below but the invention is not limited to that particular illustration and any other suitable form of separatable blades and handle may be used.

DESCRIPTION OF THE PREFERRED EMBODIMENTS

Figure 1:
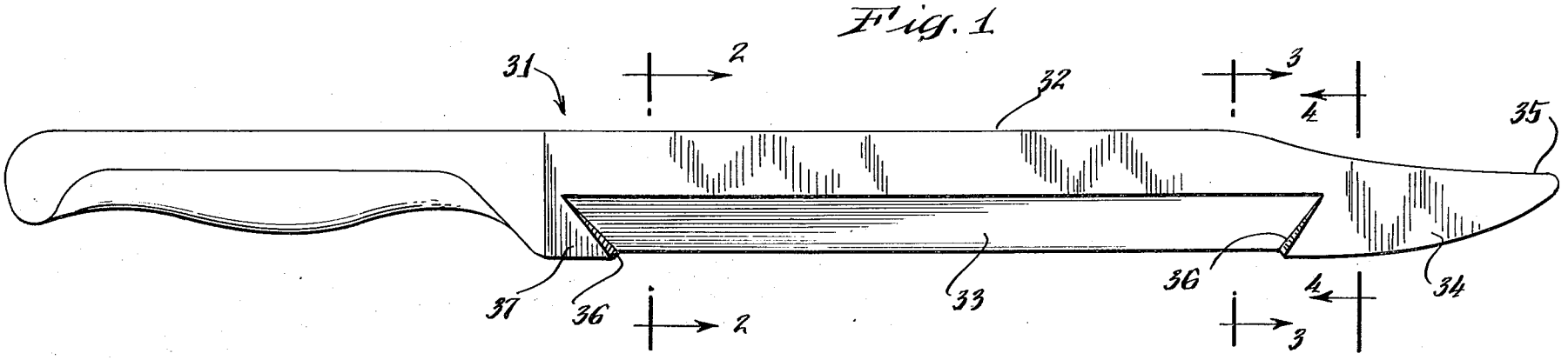
FIG. 1 shows a typical meat cutter's knife incorporating a forward runner and optionally a rear runner.
Figure 4:
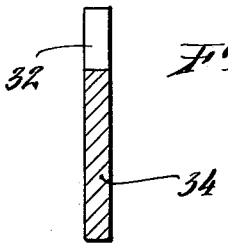
FIG. 4 is a sectional view to show the plowshaped transition zone looking rearwardly of the knife.
Figure 3:
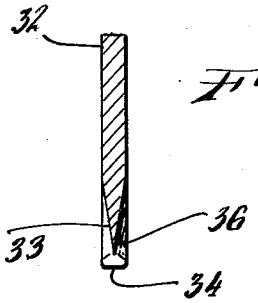
FIG. 3 is a section along the line 3—3 looking forward toward the plow-shaped transition zone.
Figure 2:
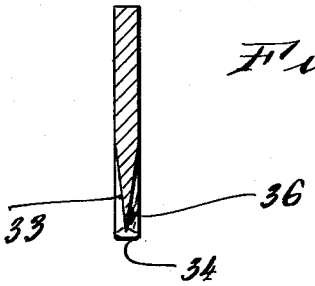
FIG. 2 is a section along the line 2—2.

FIGS. 1 to 4 illustrate a typical meat cutter's knife (31), which includes a blade portion (32) with a slightly recessed cutting edge (33). A forward runner portion is shown at (34), and is sufficiently wide to prevent cutting or scratching of substrates, such as a wood block. The runner portion tapers accurately to form the tip end (35) of the blade. In the runner portion there is a transition region (36) in the shape of a ramp which raises the meat when the knife is drawn rearwardly to bring the meat in contact with the sharp cutting edge. An optional rear runner (37) is also shown with its ramp (36) slanting forwardly toward the sharp edge.

Normally a meat cutting knife is used on a wooden block and the basic force of the cutting stroke is usually on the forward end of the knife. For this reason it is possible to eliminate the rear runner (37) without destroying the utility of the knife.

Figure 5:
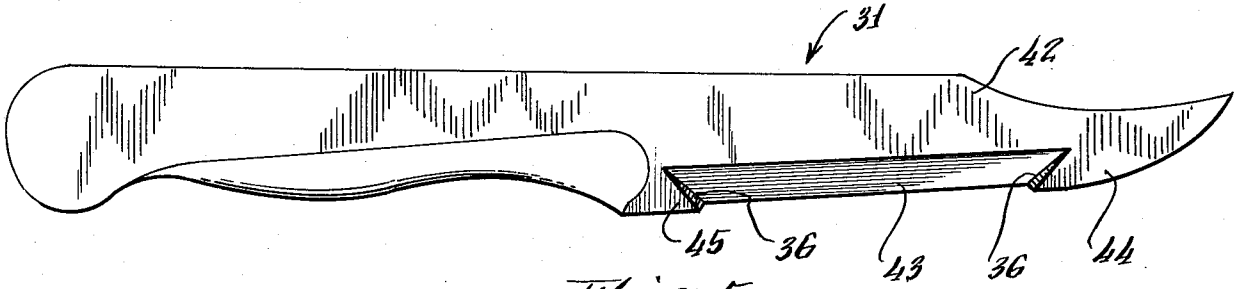
FIG. 5 is a view of a cheese knife.

FIG. 5 illustrates a cheese or bar knife (41) with a blade (42) having a recessed cutting edge (43) and forward runner (44) and rear runner (45). Such a knife is usually used on a block or tray, and the slicing action usually uses more nearly the full length of the blade. Ramps (36) are on the runners and perform the same function as in FIG. 1, and most of the following figures therefore bear the same reference numerals.

Figure 6:
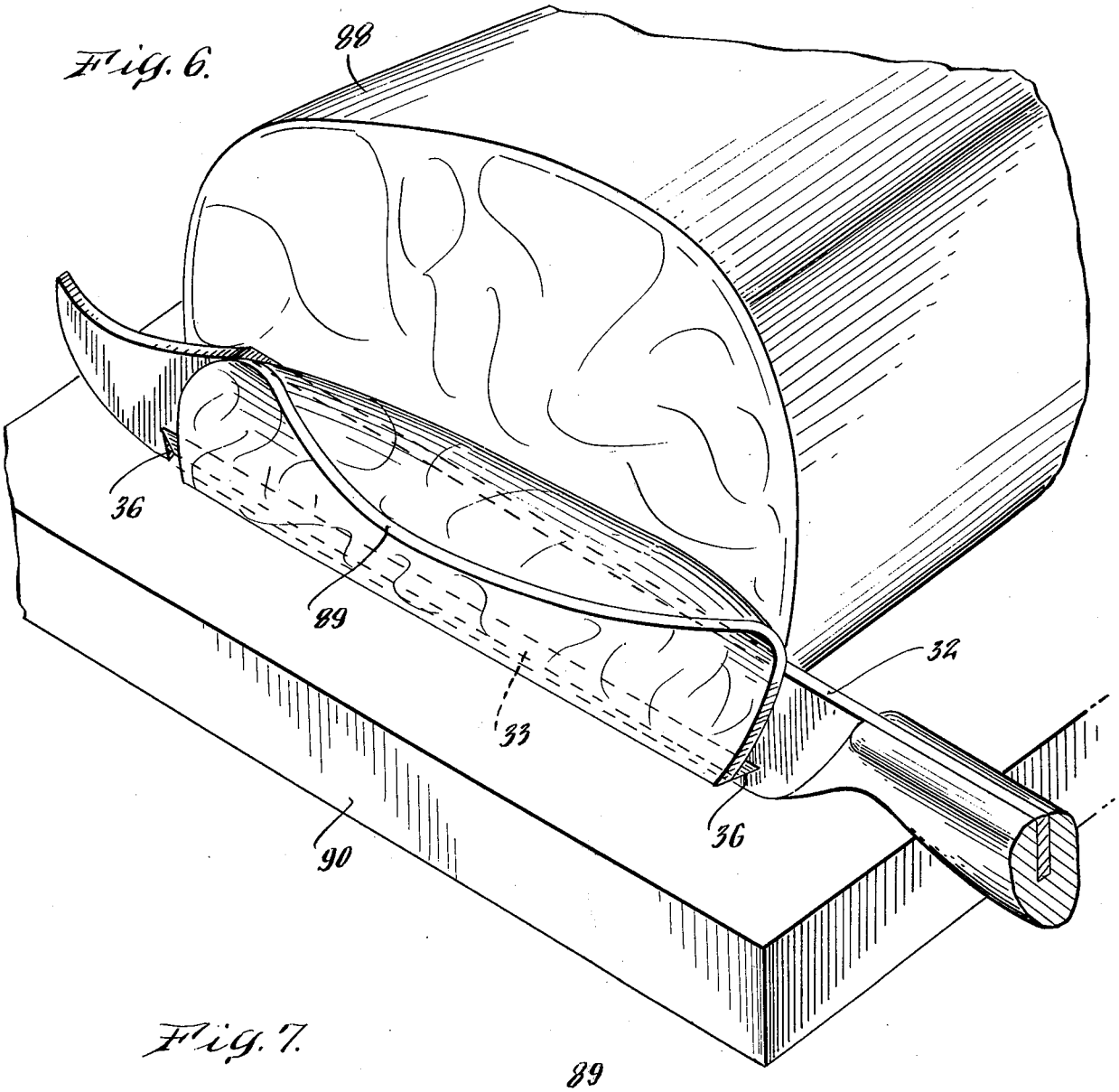
FIG. 6 is a diagrammatic elevation of a ham being sliced by a knife shown in FIG. 1.
Figure 7:
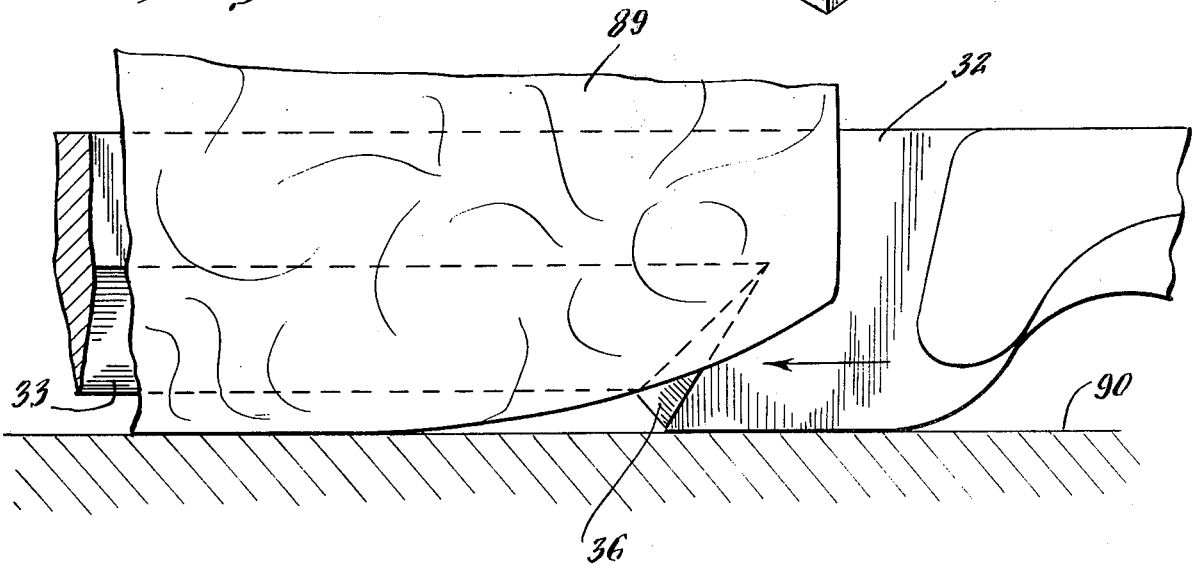
FIG. 7 is an enlarged detail of a portion of the knife in FIG. 6 showing the meat being raised by the ramps on the knife.

FIGS. 6 and 7 are diagrammatic illustrations of cutting a ham. The knife is similar to the one illustrated in FIG. 10 and illustrates the action of the ramps (36). In FIG. 6 the ham is shown at (88) with the slice being cut off at (89). A cutting board is illustrated at (90). The action of the ramps (36) is shown on the enlarged FIG. 7, which illustrates only the rear and ramp raising the meat to contact the recessed edge (33) on the forward stroke of the knife. The ramp (36) of the front runner operates in the same manner as illustrated in FIG. 7 but, of course, on the back stroke of the knife.

Figures 8, 9, 10, 11, 12, 13, 14, 15:
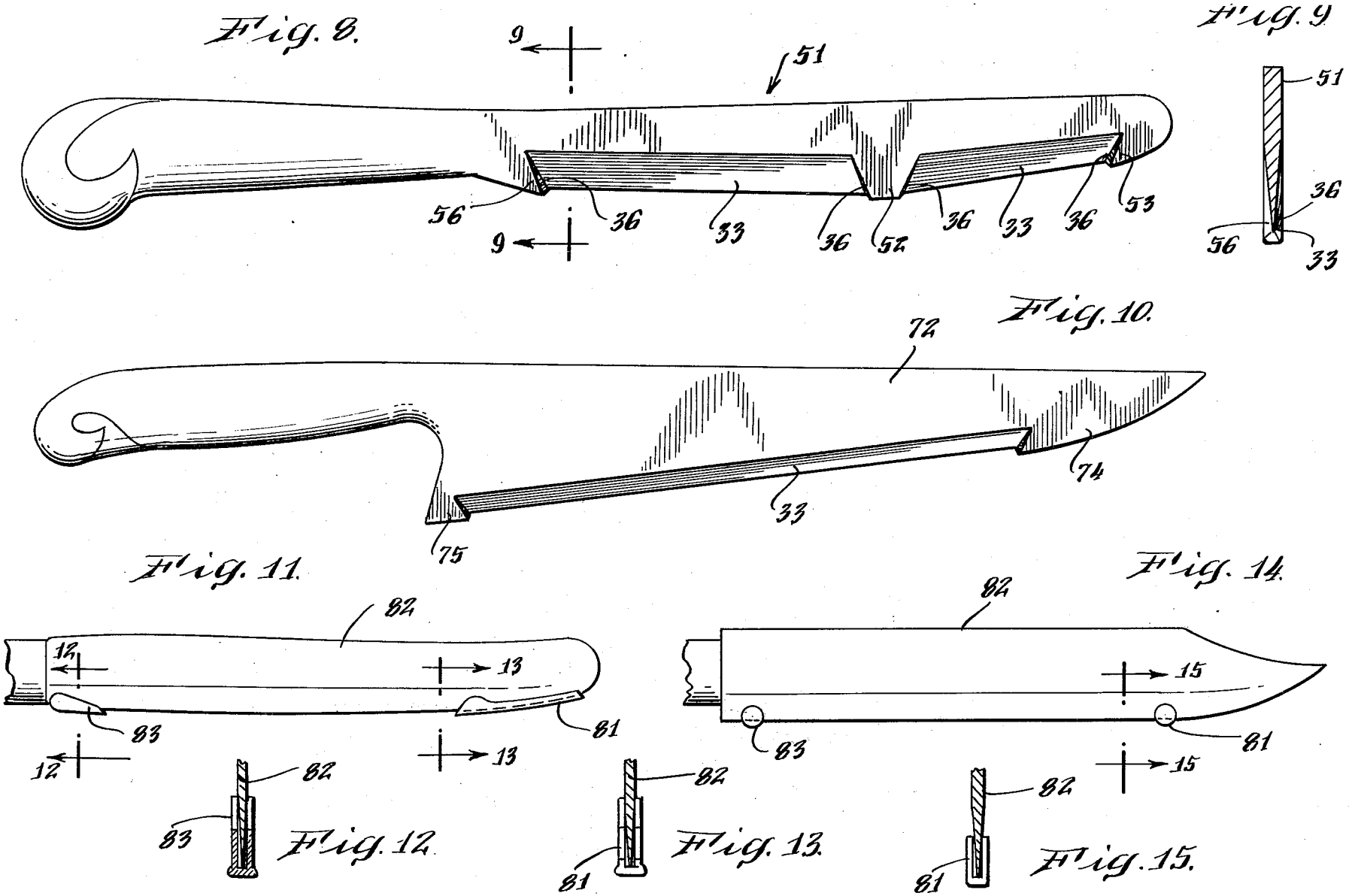
FIG. 8 is an illustration of a table knife with an additional central runner.
FIG. 9 is a cross-section along the line 9—9 of FIG. 8.
FIG. 10 shows a typical chef's knife incorporating a forward and rear runner.
FIG. 11 shows a typical knife blade edge with epoxy attachable runners.
FIGS. 12 and 13 are cross-sections along the lines 12—12 and 13—13, respectively, of FIG. 11.
FIG. 14 shows a different type blade equipped with epoxy attached modified runners.
FIG. 15 shows a cross-section along the corresponding section line of FIG. 14.

FIG. 8 illustrates a table or dinner knife (51) including a middle runner (52) as well as the forward runner (53) and rear runner (56). The ramps are shown at (36) and operate as described above. The knife is more particularly designed for a sawing action because of the lesser angle between the rear runner (54) and the center runner (52) as compared to the angle between (52) and forward runner (53). The cutting edges (33) of the knife are recessed as in the other figures.

FIG. 10 is a chef's knife, with a blade (72) having a single recessed cutting edge (33) between a forward runner (74) and rear runner (75). This type of knife is often employed in chopping around in a circle or semicircle to make salads and the like. The forward runner (74), which is longer and a different slope than some of the others, can be maintained against the chopping block or bowl.

FIG. 11 shows a knife blade (82) with attachable front runner (81) and rear runner (83). The runners fit over the blade, as can be seen in the cross-sectional views of FIGS. 12 and 13 taken along the lines (12) and (13) of FIG. 11. Epoxy cement is an example of an adhesive which is a strong adhesive suitably resistant to water and other materials which would be encountered. The particular adhesive used is not what distinguishes the present invention from the prior art and any suitable adhesive of the requisite strength and other characteristics may be used.

FIG. 14 shows a blade (82) with runners (81) and (83) attached by adhesive but of somewhat different shape than in FIG. 11.

FIG. 15 is a cross-section taken along the corresponding section line.

Figure 16:
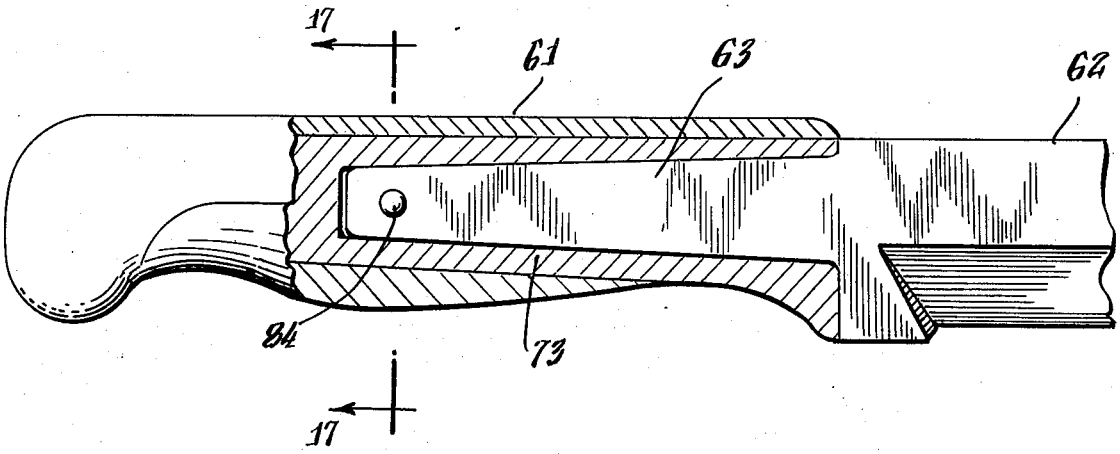
FIG. 16 is an elevation, partly broken away and a section of a knife separatable fitting into a handle.
Figure 17:
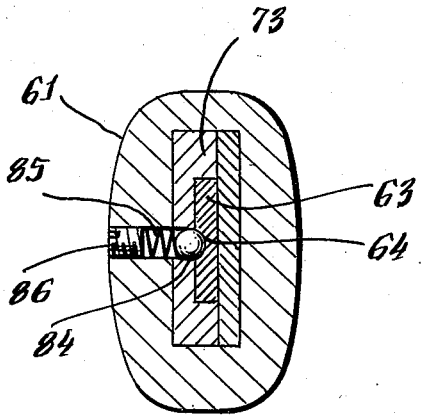
FIG. 17 is a cross-section along the line 17—17 of FIG. 16.

FIG. 16 illustrates a knife blade separably attachable to a handle. The figure shows part of the handle broken away. The blade is shown at (62) with a tang (63) which is tapered and which slides into a handle (61) which, as can best be seen in FIG. 17, is provided with a metal channel-shaped section with a covering plate (73). This provides for a sloping cavity into which the tang of the blade fits snugly. Near the end of the tang there is a recess or indent (64) into which a ball (84) snaps under the influence of a spring (85) and threaded plug (86) when the tang is fully inserted. This operates as a detent which will hold the blade firm and prevent the blade from falling out but yet the detent is not sufficiently strong so that the blade cannot be withdrawn manually and another blade substituted.

Figure 19:
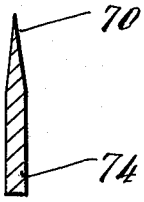
FIG. 19 is a cross-section along the line 19—19 of FIG. 18.
Figure 18:
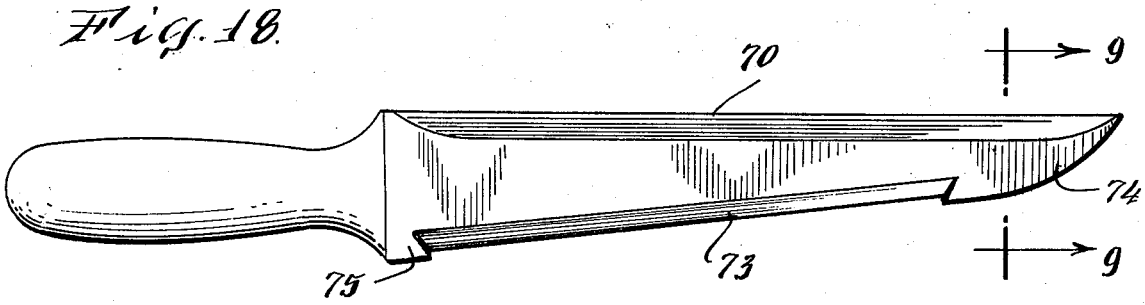
FIG. 18 is an illustration of a knife with a sharp, unrecessed edge on the top of the blade.

FIGS. 18 and 19 show a knife with one recessed blade on the bottom and a continuous sharp unrecessed blade (70) on the top. The recessed blade and front and rear runners bear the same reference numerals as in FIG. 10

I claim:

1. A knife for cutting comestibles or the like without injurying a surface supporting them comprising, in combination, a. a blade having a cutting edge;

b. at least one runner portion protruding slightly from the cutting end, at least at the forward end of the blade, and being sufficiently wide and therefore blunt so that it will not scratch or cut substrates, and c. each runner being provided on each side with a ramp inclined up toward the adjacent cutting edge, the ramp having an angle sufficiently small to permit comestibles being cut to rise along the ramp and being forced in contact with the cutting edge, whereby all of the comestibles are forced to encounter the cutting edge and no narrow strip of uncut material is left.

2. A knife according to claim 1 in which there are at least two runners at front and back ends of the blade.

3. A knife according to claim 2 in which there is at least one additional runner nearer the center of the blade, the ramps on said central runner slanting up toward each adjacent cutting edge.

4. A knife according to claim 1 in which the runner is detachable and is attached to the knife by adhesive.

5. A knife according to claim 1 provided with a tang and hollow handle which permits using a single handle for a number of blades.

* * * * *